US005954035A

United States Patent [19]

Höfer et al.

[11] Patent Number: 5,954,035

[45] Date of Patent: Sep. 21, 1999

[54] VENTING ARRANGEMENT FOR A CRANKCASE OF AN INTERNAL COMBUSTION ENGINE

[75] Inventors: Christian Höfer, Fellbach; Thomas Kettner; Siegfried Weber, both of Stuttgart; Roland Weik, Cleversulzbach, all of Germany

[73] Assignee: Daimler Chrysler AG, Stuttgart, Germany

[21] Appl. No.: 09/236,447

[22] Filed: Jan. 25, 1999

[30] Foreign Application Priority Data

Jan. 31, 1998 [DE] Germany ..... 198 03 872

[51] Int. Cl.[6] ..... F01M 1/00

[52] U.S. Cl. ..... 123/573

[58] Field of Search ..... 123/572, 573, 123/574, 41.86

[56] References Cited

U.S. PATENT DOCUMENTS 3,834,156 9/1974 Cutler et al. ..... 123/572
4,329,968 5/1982 Ishikaw et al. ..... 123/41.86
4,651,704 3/1987 Sekiguchi ..... 123/572
5,239,972 8/1993 Takeyama et al. ..... 123/41.86

FOREIGN PATENT DOCUMENTS 196 07 919 9/1997 Germany .

*Primary Examiner*—Marguerite McMahon
*Attorney, Agent, or Firm*—Klaus J. Bach

[57] ABSTRACT

In a venting arrangement for a crankcase of an internal combustion engine including a centrifugal separator having a rotatable housing with an inlet channel for the admission of an oil-air mixture and an exit channel for the discharge of air from which the oil has been removed, the inlet channel extends essentially in a direction parallel to the axis of rotation of the housing, but in spaced relationship from the axis so that oil which has been separated from the oil-air mixture moves, subjected to centrifugal forces, radially outwardly at a 90° angle to the generally axial oil-air mixture flow through the separator.

11 Claims, 1 Drawing Sheet

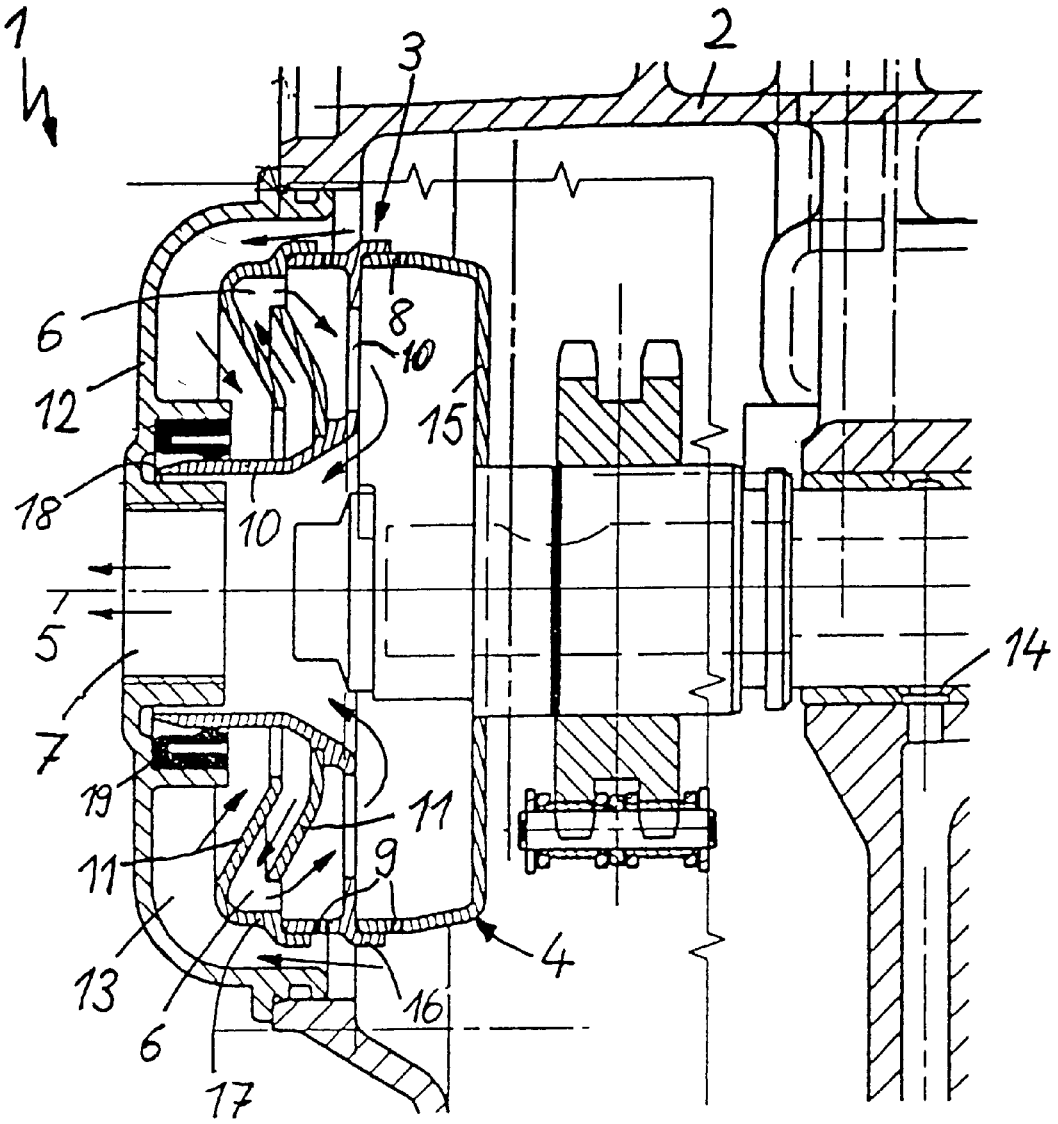
1
2
3
6
8
10
12
15
18
10
5
14
7
19
11
11
9
4
13
16
6
17

VENTING ARRANGEMENT FOR A CRANKCASE OF AN INTERNAL COMBUSTION ENGINE

BACKGROUND OF THE INVENTION

The invention resides in venting arrangement for a crankcase of an internal combustion engine including a centrifugal oil separator with a housing having an inlet passage for the admission of an oil-air mixture and an outlet opening for the discharge of purified air.

Such a venting arrangement is known for example from DE 196 07 919 A1, wherein the oil particles in the oil-air mixture of an engine crankshaft are removed from the mixture and are returned to the crankcase. The venting arrangement includes a centrifugal oil separator with a rotating housing which has several radial inlet passages which lead to a central axially extending exit channel. The oil air mixture is conducted radially from the outside to the inside by way of the inlet passages in which baffles are arranged. Because o:f the centrifugal forces generated by the rotation of the housing, the oil particles of the oil-air mixture are deposited on the baffles and move radially outwardly against the in-flowing oil-air mixture. The air from which the oil particles have been removed exits by way of a discharge conduit and is supplied to the air intake duct of the engine.

This venting arrangement has the disadvantage that, on one hand, the oil air mixture is conducted from the outside radially inwardly and, on the other hand, the oil particles deposited are directed again outwardly against the inward flow of the air-oil mixture so that two opposed flows are formed in the inlet channel. This results in a limited efficiency of the venting arrangement with regard to flow volume as well as the separation effectiveness. The opposite flows inhibit each other and cause re-entrainment of oil particles in the air. Also, an increase in the speed of the centrifugal separator will not lead to an improved efficiency since, with increasing rotational speed, the outwardly flowing oil increasingly carries along the inwardly directed air-oil mixture flow.

It is further disadvantageous that a certain minimum excess pressure must be established in the housing interior to provide for the inward flow of the oil-air mixture. Also, this inwardly directed flow detrimentally affects the purification degree since oil particles which had been deposited but are again thrown outwardly by the centrifugal forces are re-entrained in the oil-air flow and are again carried into the interior of the housing.

It is the object of the present invention to improve the efficiency of a venting arrangement including a centrifugal oil separator by simple means.

SUMMARY OF THE INVENTION

In a venting arrangement for a crankcase of an internal combustion engine including a centrifugal separator having a rotatable housing with an inlet channel for the admission of an oil-air mixture and an exit channel for the discharge of air from which the oil has been removed, the inlet channel extends essentially in a direction parallel to the axis of rotation of the housing, but in spaced relationship from the axis so that oil which has been separated from the oil-air mixture moves, subjected to centrifugal forces, radially outwardly at a 90° angle to the generally axial oil-air mixture flow through the separator.

Because of the arrangement of the inlet channel in a direction parallel to the axis of rotation of the housing of the oil separator, the directional vectors of the inflowing oil-air mixture and the oil thrown in the inlet channel radially outwardly are about normal to each other. As a result, the two flows are essential uncoupled from each other so that neither one impedes the other flow. Since no counter currents are established the vacuum generated in the intake manifold of the internal combustion engine is sufficient to generate an oil-air mixture flow into the housing of the oil separator. At the same time, the oil particles are moved radially outwardly because of the centrifugal forces generated by the rotational movement and they are deposited on the inside of the outer wall of the inlet channel. This increases the oil separation rate and also the flow volume of the oil air mixture moved through the oil separator during a given time period.

Another advantage is provided by the axial flow direction of the oil-air mixture entering the oil separator. In such a flow, the oil-air mixture is not subjected to any, or only to small, centrifugal forces ahead of the inlet opening of the housing of the oil separator and the flow of the mixture into the housing is not inhibited. Preferably, the outside wall of the inlet channel is a radial wall section of the housing and the inlet opening of the inlet channel is at ore axial end of the housing so that the mixture enters the inlet channel in an axial direction. This arrangement is particularly simple since no additional wall is needed for forming the inlet channel. The outer wall is preferably provided with bores through which the oil separated from the air-oil mixture can leave.

The inlet channel is preferably annular in shape so as to facilitate the inflow of the oil-air mixture into the housing over the whole circumference of the housing. With such a radially symmetrical arrangement, the largest possible flow volume can be obtained.

Preferably, a separating wall is arranged between the in-let channel and the interior space of the separator which is in communication with the exit opening. This has various advantages. It provides for a well-defined flow direction in the inlet channel about parallel to the rotational axis and it prevents an inadvertent transgression of oil-air mixture into the area of the exit opening. Furthermore, it provides the possibility of arranging in the inlet channel baffles not only on the outside wall but additionally on this separating wall. The baffles redirect the in-flowing oil-air mixture flow several times thereby causing effective removal of the oil particles. Finally, the separating wall can be rotatably supported on a cover which is mounted to the crankcase in such a way that the oil separator is additionally supported and, at the same time, seals the interior of the crankcase with respect to atmosphere.

The baffles arranged in the inlet channel are preferably angled webs projecting into the inlet channel. There may be two webs arranged one after the other and projecting into the inlet channel alternately from the outer wall and from the separating wall so that the in-flowing mixture is at least once deflected and oil is deposited on the surfaces of the webs.

Between the cover and the housing of the oil separator, preferably an admission channel is formed which guides the oil air mixture in the interior of the crankcase to the inlet channel. This admission channel provides preferably for a redirection of the flow by 180° so that oil particles are already deposited on the inner wall of the admission channel thereby providing for a pre-separation of oil particles from the oil-air mixture flowing through the admission channel.

Other the advantages and embodiments of the invention will become apparent from the following description on the basis of the accompanying drawing.

BRIEF DESCRIPTION OF THE DRAWING

The sole FIGURE is a cross-sectional view of the crankcase venting arrangement with a centrifugal oil separator according to the invention.

DESCRIPTION OF A PREFERRED EMBODIMENT

The FIGURE shows a venting arrangement 1 for venting the oil-air mixture generated in a crankcase 2 of an internal combustion engine. The venting arrangement 1 comprises a centrifugal oil separator 3, which is connected for rotation with a compensating shaft 14 and which includes an end cover 12 disposed in the wall area of the crankcase 2. The oil separator 3 rotates at the same speed as the compensating shaft 14, the oil separator 3 and the compensating shaft 14 having a common axis of rotation 5.

It may however be suitable to connect the oil separator to the crankshaft or to the camshaft or to drive it by a chain.

The oil separator 3 includes an essentially cylindrical housing 4, which consists of a pot-like base body 15, a first annular component 16 and a second annular component 17. The first annular component 16 is seated on the front end of the base body 15 and the second annular component 17 is mounted on the first annular component. The base body 15 and the two annular components 16, 17 form a unit and are firmly interconnected.

The housing 4 of the oil separator 3 includes a sleeve-like separation wall 10, which is formed integrally with the first annular component 16. Radially between the separation wall 10 and the radially outer wall of the housing 4, an inlet channel 6 is formed which extends essentially parallel to the axis of rotation 5 at a radial distance therefrom. The inlet opening of the inlet channel 6 is disposed in the area of the axial front end of the housing 4 and is directed toward the end cover 12. The inlet channel 6 is annular; accordingly, the inlet opening at the axial front end extends over 360°, that is, over the whole circumference. In place of an annular inlet channel, several inlet passages distributed over the circumference may be provided. The base body 15 has an annular wall portion 8, which forms an outer wall of the inlet channel 6 in the area of the first annular component. Between the annular wall portion 8 and the sleeve-like separation wall 10, a passage 10*a* is formed by way of which the inlet channel 6 is in communication with the interior of the cylindrical housing 4.

The end cover 12 is firmly mounted on the crankcase 2 and includes an annular recess 18 into which the free end portion of the separation wall 10 extends so as to be rotatable therein. A seal ring 19 is disposed in the annular recess 18 and sealingly engages the end portion of the separation wall 10 to seal the interior of the oil separator against the interior of the crankcase to prevent re-circulation of air through the oil separator. The end cover 12 includes an axial exit opening 7 by way of which the interior of the crankcase is in communication with an intake duct of the internal combustion engine. Between the inner wall of the end cover 12 facing the interior of the crankcase and the cylindrical housing 4 of the oil separator 3, there is a admission channel 13 by way of which the oil-air mixture is conducted from the crankcase interior to the inlet channel 6. The admission channel 13 redirects the axially incoming oil-air mixture by 180° and conducts the mixture into the housing 4.

There is no need for such an admission channel if the in-let opening of the oil separator is arranged at the other side of the oil separator opposite the end cover.

The inlet channel 6 includes baffles 11 in the form of angled webs, which project into the inlet channel 6. Several baffles 11 are arranged in flow direction behind one another and extend into the inlet channel alternately from opposite sides. One baffle 11 extends into the inlet channel 6 from the second annular component 17 of the cylindrical housing and is formed integrally therewith. Another baffle 11 extends into the inlet channel 6 from the separation wall 10. The oil-air mixture flows in the inlet channel 6 around the baffles 11 so that its direction is changed several times by 180° as indicated by the arrows. The annular wall portion 8 of the inlet channel 6 includes discharge bores 9 arranged evenly distributed around its circumference for the discharge of oil separated from the oil-air mixture. Such discharge bores 9 may be provided in the base body 15 and also in the first annular component 16 and possibly also in the second annular component 17. Instead of bores, other openings with any cross-section such as gaps permitting the outflow of oil may be provided. For design reasons, it may also be advantages if the discharge bores are non-uniformly distributed around the circumference.

The oil separation operates as follows:

The oil-air mixture flows from the crankcase interior in the direction as indicated by the arrows into the admission channel 6, whereby the mixture is conducted past the baffles 11. The oil contained in the mixture is deposited on the walls of the baffles and, respectively, on the inside of the annular wall portion 8. Because of the rotation of the housing 4, which is mounted for rotation with the compensating shaft 14, the oil particles are subjected to centrifugal forces so that they move toward the outer annular wall portion 8 and are radially discharged through the discharge bores 9 back into the crankcase. The oil-air mixture flow is not inhibited by the rotation of the cylindrical housing 4 so that the air from which the oil particles have been removed can freely flow to the center of the housing 4 and can leave the oil separator through the exit opening 7.

What is claimed is:

1. A venting arrangement for a crankcase of an internal combustion engine comprising: a centrifugal oil separator supported so as to be rotatable about an axis of rotation and being connected to means for rotating said centrifugal oil separator, said centrifugal oil separator including a housing with an inlet channel for the admission of an oil-air mixture and an exit channel for the discharge of the air from which the oil has been removed, said inlet channel extending essentially in a direction parallel to said axis of rotation, but in radially spaced relationship therefrom.

2. A venting arrangement according to claim 1, wherein said housing has a radially outer annular wall and said inlet channel extends along said radially outer annular wall.

3. A venting arrangement according to claim 2, wherein said radially outer annular wall is provided with discharge openings for discharging oil separated from said oil-air mixture.

4. A venting arrangement according to claim 1, wherein an annular separation wall is arranged between within said radially outer annular wall in radially spaced relationship therefrom to form said inlet channel.

5. A venting arrangement according to claim 1, wherein baffles are arranged in said inlet channel which redirect said oil-air mixture for the separation of said oil therefrom.

6. A venting arrangement according to claim 1, wherein baffles are arranged in said inlet channel for the separation of oil from the oil-air mixture flowing therethrough.

7. A venting arrangement according to claim 6, wherein said baffles are webs angularly projecting into said inlet channel.

8. A venting arrangement according to claim 6, wherein at least two baffles are arranged in said inlet channel in axially spaced relationship.

9. A venting arrangement according to claim 1, wherein said housing includes a cover mounted to said crankcase and an admission channel is formed between said cover and said housing leading said oil-air mixture to said inlet channel.

10. A venting arrangement according to claim 9, wherein said inlet channel joins said admission channel with a 180° change of flow direction.

11. A venting arrangement according to claim 1, wherein said housing is connected to a compensating shaft for rotation therewith.

* * * * *